US008882898B2

(12) United States Patent
Fang et al.

(10) Patent No.: US 8,882,898 B2
(45) Date of Patent: Nov. 11, 2014

(54) EMULSIFIED RELEASE AGENT FOR COMPOSITE PANEL

(75) Inventors: Jiping Fang, Fort Saskatchewan (CA); Stewart A. Roth, Fort Saskatchewan (CA)

(73) Assignee: Guardian Chemicals, Inc., Sturgeon County, Alberta (CA)

( * ) Notice: Subject to any disclaimer, the term of this patent is extended or adjusted under 35 U.S.C. 154(b) by 413 days.

(21) Appl. No.: 13/512,587

(22) PCT Filed: Nov. 29, 2010

(86) PCT No.: PCT/CA2010/001891

§ 371 (c)(1), (2), (4) Date: Aug. 6, 2012

(87) PCT Pub. No.: WO2011/063525

PCT Pub. Date: Jun. 3, 2011

(65) Prior Publication Data

US 2012/0301622 A1 Nov. 29, 2012

(51) Int. Cl.
*B27N 3/08* (2006.01)
*C10M 173/02* (2006.01)

(52) U.S. Cl.
CPC ..... *B27N 3/083* (2013.01); *C10M 173/02* (2013.01); *C10M 2207/126* (2013.01); *C10M 2207/18* (2013.01); *C10M 2209/104* (2013.01); *C10M 2219/104* (2013.01); *C10M 2223/042* (2013.01); *C10N 2210/01* (2013.01); *C10N 2230/18* (2013.01); *C10N 2240/58* (2013.01); *C10N 2250/021* (2013.01)
USPC ..... 106/38.24

(58) Field of Classification Search
CPC ..... B27N 3/08; B27N 3/083
USPC ..... 106/38.24
See application file for complete search history.

(56) References Cited

U.S. PATENT DOCUMENTS

| | | | | | |
|---|---|---|---|---|---|
| 4,257,995 | A * | 3/1981 | McLaughlin et al. | ..... | 264/122 |
| 4,258,169 | A * | 3/1981 | Prather et al. | ..... | 528/72 |
| 4,352,696 | A * | 10/1982 | Prather | ..... | 106/164.3 |
| 4,374,791 | A * | 2/1983 | Farrissey et al. | ..... | 264/39 |
| 6,132,503 | A * | 10/2000 | Singule et al. | ..... | 106/271 |
| 8,309,503 | B2 * | 11/2012 | Fang et al. | ..... | 510/200 |
| 2005/0155691 | A1 * | 7/2005 | Nowak et al. | ..... | 156/62.2 |
| 2005/0242459 | A1 * | 11/2005 | Savino et al. | ..... | 264/109 |
| 2012/0121810 | A1 * | 5/2012 | Grigsby et al. | ..... | 427/369 |

* cited by examiner

*Primary Examiner* — David M Brunsman

(57) ABSTRACT

The present invention is directed to an emulsified release agent for use in manufacturing of wood products from wood fibers or chips with pMDI adhesives, where the application process for the release agent would normally agitate the release agent. The emulsified release agent is simple to manufacture, has good stability and storage, provides effective release between the wood product and the metal surfaces, allows for production of wood products from wood fibers or chips at high temperature, without causing excessive press buildup and improves the physical properties of the wood product and shortens press time. The emulsified release agent composition for use with a pMDI adhesive comprises an emulsified mixture of: (a) an alkali metal salt of a fatty acid having 8-18 carbon atoms, and (b) an alkali metal salt of a phosphate ester having 6-22 carbon atoms and having an HLB number of 4 or less.

18 Claims, No Drawings

EMULSIFIED RELEASE AGENT FOR COMPOSITE PANEL

FIELD OF THE INVENTION

The present invention is directed to a novel emulsified release agent specially designed for use in the production of manufactured wood products, in particular fiberboard, particle board and oriented strand board using 100% polymeric dimethyl phenate di-isocyanate (pMDI) adhesive.

BACKGROUND OF THE INVENTION

The manufacture of wood products from wood fibers or chips, such as fiberboard, particle board and oriented strand board (OSB) is well known. Typically, the wood fibers or chips are mixed with a suitable adhesive and wax emulsion and the mixture is then matted and pressed under high pressure and temperature to form a rigid, dense panel. OSB is manufactured using chips or strands sliced from logs in the orientation of the grain. Typically the strands are 4-6 inches in length and 1 inch wide and have a uniform thickness. After drying and sorting, the strands are mixed with the wax and adhesive and oriented in layers. The strands in the layers which will form the exterior surface of the panel are aligned in the long direction of the panel while the inner layers are cross-aligned to the surface layers.

The adhesives commonly employed in the manufacture of wood products from wood fibers or chips include phenolic resins or isocyanate binders. Phenolic resins, produced by reacting phenol with formaldehyde under alkaline conditions have been used for many years. Recently, there have been concerns raised about the production, use and handling of such resins and a number of manufacturers have switched to using isocyanate binders. Liquid polymeric dimethyl phenate di-isocyanate (pMDI) is now becoming the binder of choice. pMDI is an excellent adhesive and provide advantages for the board over other adhesives. However, pMDI provides adhesion not only for the wood fibers, but also for the boards to the metal press platens, caul plates or stainless steel screens used in the manufacturing process. Therefore, many producers of wood products manufactured from wood fibers or chips will use a surface layer of non-pMDI bonded wood fibers or chips, such as phenol formaldehyde resin, and use pMDI in the core layer of the board to prevent the adhesion between pMDI in the mat and the metal surfaces. This complicated surface-core sandwiching process has increased the cost of board manufacturing and has prevented the industry from benefiting fully from pMDI adhesive.

There have been attempts to overcome the above bonding to the metal surfaces through the use of release agents. Many conventional release agents as used in the industry do not provide satisfactory release. Some of these require elaborate and costly processes for pre-treatment of the press platens, such as applying internal and external release agents, multiple coatings and baking the platens. Other release agents can provide good release, but must be applied in high concentration of up to 80% and require much lower press temperatures and longer press time, thus increasing production time and cost. Some release agents based on higher surface active materials such as silicones may remain associated with the finished board surface and thus affect the paintability of the board.

We have previously developed a release agent composition for use with a pMDI adhesive comprising a mixture of an alkali metal salt of a fatty acid having at least 8 carbon atoms and an alkali metal salt of an ethoxylated phosphate ester having 8-16 carbon atoms. This formulation was a solution marketed as PRESSGUARD™ (Guardian Chemicals Inc.) and had certain advantages when sprayed on the strand mat or caul plate using spray bar systems, which are commonly used in North America. However, when it was attempted to apply the release agent by other methods which agitate the release agent, such as spinning disc spray or rotating roller systems, which are popular in Europe and Asia, it was found that the agitation and turbulence of those methods caused unacceptable foaming of the release agent. This tendency to foam impacted the release agent application rate resulting in reduced coverage and slower performance.

In applications where foaming is encountered, the traditional solution is the use of a de-foaming agent. There are however problems with this approach. De-foaming agents tend not to be soluble in water-based solutions and need added hydrotropes to increase their solubility. De-foaming agents in such solutions tend not to be stable, especially on storage or if the solution is diluted for final application. On dilution, the effect of the hydrotrope is reduced and the de-foaming agent may come out of solution, leading to separation and loss of de-foaming properties. One solution to these problems has been the application in a separate step of a de-foaming agent. However, this requires additional equipment for the de-foaming agent to be separately applied. In addition, many de-foaming agents are silicone-based which can cause problems with paintability of the final board.

Thus there still remains a need for a pMDI release agent which has significantly reduced or eliminated foaming tendencies and will provide effective release between the board and the metal surfaces in conventional processes using conventional equipment at conventional speeds.

SUMMARY OF THE INVENTION

The present invention is directed to an emulsified pMDI release agent for application processes which significantly agitate the release agent. The emulsified release agent is simple to manufacture and has good stability and storage characteristics. In addition, the emulsified release agent provides effective release during production of wood products from wood fibers or chips, in conventional processes at conventional speeds using many popular release agent application systems including high agitation systems such as spinning disc spray or rotating roller systems, without causing excessive press buildup. Moreover, the lack of the need to add a de-foaming agent, particularly those which are silicone-based, yields finished boards with improved physical properties.

In one aspect of the invention, there is provided an emulsified release agent composition for use with a pMDI adhesive comprising an emulsified mixture of:

(a) an alkali metal salt of a fatty acid having 8-18 carbon atoms, and (b) an alkali metal salt of a phosphate ester having 6-22 carbon atoms and having an hydrophilic-lipophilic balance (HLB) number of 4 or less.

In another aspect of the invention, the emulsified release agent composition further includes (c) an ethoxylated fatty alcohol having an alkyl chain length of 8-18 carbon atoms.

In a further aspect of the invention, the emulsified release agent composition comprises (a) 1-20% by weight of an alkali metal salt of a fatty acid having 8-18 carbon atoms;

(b) 1-20% by weight of an alkali metal salt of a phosphate ester having 6-22 carbon atoms and having an HLB number of 4 or less;

(c) 0-10% by weight of an ethoxylated fatty alcohol having an alkyl chain length of 8-18 carbon atoms;
(d) 0.05-0.5% by weight of a preservative; and
(e) the balance by weight of deionized water.

In a further aspect of the invention, the emulsified release agent composition comprises
(a) 10-12% by weight of an alkali metal salt of a fatty acid having 8-10 carbon atoms;
(b) 10-12% by weight of an alkali metal salt of a phosphate ester having 8-12 carbon atoms and having an HLB number of 4 or less;
(c) 0-5% by weight of an ethoxylated fatty alcohol having an alkyl chain length of 8-18 carbon atoms;
(d) 0.2% by weight of a preservative; and
(d) 70.8-79.8% by weight deionized water.

In yet another aspect of the invention the alkali metal salt of the fatty acid and the phosphate ester is a sodium salt.

In another aspect of the invention, there is provided a method for applying an emulsified release agent to a fiber or chip mat or caul plate used in the manufacture of wood products from wood fibers or chips. The method comprises providing a emulsified release agent comprising (a) 1-20% by weight of an alkali metal salt of a fatty acid having 8-18 carbon atoms; (b) 1-20% by weight of an alkali metal salt of a phosphate ester having 6-22 carbon atoms and having an HLB number of 4 or less; (c) 0-10% by weight of an ethoxylated fatty alcohol having an alkyl chain length of 8-18 carbon atoms; (d) 0.05-0.5% by weight of a preservative; and (e) the balance by weight of deionized water. The emulsified release agent is loaded in a spinning disk spray system or a rotating roller application system and thereafter applied to the fiber or chip mat or caul plate using said system.

DETAILED DESCRIPTION OF THE PREFERRED EMBODIMENTS

The present invention is directed to an emulsified pMDI release agent for application processes which normally agitate a release agent and cause foaming of the release agent. The emulsified release agent is simple to manufacture and has good stability and storage properties. The emulsified release agent provides effective release during production of wood products from wood fibers or chips such as fiber boards and particle boards, particularly OSB, in conventional processes at conventional speeds using many popular release agent application systems including high agitation systems such as spinning disc spray or rotating roller systems, without causing excessive press buildup.

The emulsified release agent composition for use with a pMDI adhesive comprises an emulsified mixture of:
(a) an alkali metal salt of a fatty acid having 8-18 carbon atoms, and
(b) an alkali metal salt of a phosphate ester having 6-22 carbon atoms and having an HLB number of 4 or less.

It has been surprisingly found that providing an alkali metal salt of a fatty acid and an alkali metal salt of a phosphate ester having an HLB number of 4 or less in water based system with mixing produces a smooth, stable emulsion. The emulsified release agent composition does not separate, even on dilution, and does not foam when used in application processes which significantly agitate the release agent during the application process, such as spinning disc spray or rotating roller systems.

The alkali metal salt of the fatty acid is used as a surfactant and has between 8 and 18 carbon atoms, more preferably between 8 and 16 and most preferably between 8 and 10 carbon atoms. The fatty acid may be saturated or unsaturated with unsaturated fatty acids being preferred. The fatty acid may be a single fatty acid such as palmitic acid, oleic acid, or linoleic acid or it may be a mixture of fatty acids such as is found in a preparation such as tall oil fatty acid. The alkali metal salt of the fatty acid is preferably produced by mixing an alkali metal hydroxide solution with the fatty acid until the reaction completes. The amount of the alkali metal salt of the fatty acid in the compositions of the present invention will be between 1% and 20% by weight, more preferably between 5% and 15% by weight, most preferably about 10-12% by weight, based on the total weight of the composition.

The alkali metal salt of a phosphate ester having an HLB number of 4 or less is believed to bond to the metal of the plates and aid in the release properties of the alkali metal of the fatty acid. The HLB number is determined using the standard formulas, such as that described in Griffin WC: "Classification of Surface-Active Agents by 'HLB,'" Journal of the Society of Cosmetic Chemists 1 (1949): 311. Preferably, the alkali metal salt of a phosphate ester will have an HLB number of 3-4. More preferably, the alkali metal salt of a phosphate ester will be an alkali metal salt of a non-ethoxylated phosphate ester.

The alkali metal salt of a phosphate ester having an HLB number of 4 or less preferably has 6-22 carbon atoms, more preferably 8-18 carbon atoms and most preferably between 8 and 10 carbon atoms. Straight or branched chains or cyclic groups of the phosphate ester may be used. The alkali metal salt of a phosphate ester having an HLB number of 4 or less may be a mono-ester, a di-ester or a mixture of mono- and di-esters. The amount of the alkali metal salt of the phosphate ester having an HLB number of 4 or less in the compositions of the present invention will be between 1% and 20% by weight, more preferably between 5% and 15% by weight, most preferably about 10-12% by weight, based on the total weight of the composition.

The alkali metal salt of the fatty acid or the phosphate ester having an HLB number of 4 or less may be any of the commonly employed alkali metal salts. Preferably, the alkali metal salt is a potassium, sodium or lithium salt, more preferably potassium or sodium salt, most preferably a sodium salt.

In addition to the above two components, the composition of the present invention may optionally contain other components such as other surfactants, etc., so long as they do not impact the functioning of the emulsified release agent. For example, other surfactants, such as fluorinated or siliconated surfactants can be used in the formula to promote the wetting and penetration ability. One preferred additional component is an ethoxylated fatty alcohol having an alkyl chain length of 8-18 carbon atoms. More preferably, the ethoxylated fatty alcohol has an alkyl chain length of 10-16 carbon atoms with from 3 to 12 ethoxyl groups. The alkyl group of the ethoxylated fatty alcohol may be straight or branched or cyclic, more preferably straight or branched alkyl chains. Such additional components can be present in amount up to about 10% by weight of the composition, more preferably up to about 5% by weight of the composition.

In addition, the composition of the present invention may also contain 0.05-0.5% by weight of a suitable preservative. Preferably the preservative is present in an amount of about 0.2% by weight. More preferably, the preservative is 2-bromo-2-nitropropane-1,3-diol, 5-chloro-2-methyl-4-isothiazolin-3-one, 2-methyl-4-isothiazolin-3-one or 1,3-benzothiazol-2-ylsulfanylmethyl thiocyanate.

In addition to the above components, the composition will contain water and an agent to adjust the pH to the preferred range of 5 to 10, most preferably a range of pH of about pH 6 to about pH 7. Preferably, NaOH or KOH is used to adjust the pH.

Once formulated, the composition of the present invention is used as an emulsified release agent for the manufacture of wood products from wood fibers or chips utilizing pMDI as the adhesive. The composition of the present invention is applied to either the surface of the mat of fibers or chips used to form the manufactured wood product or to the surfaces of the caul plates used in the presses. Preferably, the composition is applied to the caul plates to ensure uniform coating of the emulsified release agent. In order to make the application process easier, it is preferred if the emulsified release agent composition is diluted with water before application. The composition may be diluted with up to 40 parts by weight of water per 1 part by weight of the emulsified release agent, more preferably 10 to 20 parts by weight of water per 1 part by weight of the emulsified release agent. The composition is generally applied to the surfaces of the caul plates at an application rate of at least about 0.1 g/m$^2$ of the active ingredients and preferably at an application rate of at least about 0.13 g/m$^2$ of the active ingredients. When applying the composition to the surface of the mat fibers, application rates of up to about 1 g/m$^2$ of the active ingredients may be used. For the diluted composition, the application rates for the final diluted composition will generally be in the range of up to about 50 g/m$^2$ of the diluted composition. The composition of the present invention provides for excellent release of the finished wood product from the caul plates.

The following examples are illustrative of the preferred embodiments of the present invention, but the present invention is not limited to the examples.

Example 1

Preparation of Emulsified Release Agent Composition 77.10 gram of deionized water was weighed in a beaker and 2.60 gram of 50% NaOH was added while mixing; Then 10.10 gram of tall oil fatty acids was added and mixed till a clear yellow liquid was obtained. 10 gram of phosphate ester based on oleocetyl alcohol having an HLB number of 3 to 4 was added while mixing for 10 minutes; then 0.2 gram preservatives was added while mixing till a smooth milky white stable emulsion was obtained. Release agent physical properties:

Appearance: White viscous emulsion with mild odor
Specific Gravity 0.988 g/L@22° C.
pH 6.8

Example 2

Stability Test of Emulsified Release Agent Composition

A sample of release agent prepared in accordance with Example 1 was divided into four separate 25 ml, capped, glass, viewing tubes. The tubes were individually marked as follows: +40° C., RT, +6° C., and −12° C. The RT stands for ambient Room Temperature. The daily ambient RT during the duration of the analysis was kept at approximately 22° C. The samples were run through 4 complete cycles of temperature variation. Each cycle included 16 hours at the indicated temperature and 8 hours at RT, at which point the observations for visual stability characteristics were made. Then another cycle was immediately started. A 5th cycle was completed where the samples were held at their respective temperatures for 3 days and then returned to RT for observations. The results are shown in Table 1:

TABLE 1

Visual Stability Characteristics

| Cycle | 1 | 2 | 3 | 4 | 5 |
|---|---|---|---|---|---|
| +40° C. | Good | Slight | Slight | Slight | Slight |
| RT | Excellent | Excellent | Excellent | Excellent | Excellent |
| +6° C. | Excellent | Excellent | Excellent | Excellent | Excellent |
| −12° C. | Excellent | Excellent | Excellent | Excellent | Excellent |

*NOTES*
−12° C. represents Freeze/Thaw stability test.
"Excellent" represents no visible discoloration or separation.
"Good" represents a slight discoloration but no separation.
"Slight" represents a small degree (<5%) of phase separation on the surface.

The release agent, as prepared, had an Excellent to Good stability rating over a wide range of temperatures. The small degree of phase separation noted on Cycle 2 for the +40° C. sample did not increase with further cycles of temperature change.

The release agent was also diluted to 10% by weight with de-ionized water to form a stable, uniform dispersion. The dispersion was kept at RT for two weeks and no sign of separation was observed.

Example 3

Production of Fiberboard Samples

Two hundred pounds softwood strands were ground to produce very fine fibers and blended with pMDI-resin at 5% of the oven dry weight of the wood fibers (% odw) in a 5 foot diameter by two foot deep blender. In order to effectively blend the fibers for the panels, the fibers were blended in 3 batches. At the onset of the test, the caul plates were freshly sanded with 120 grit sand paper and the surface dust removed. A 10% solution of Release Agent (designated XP 1001J) prepared in accordance with Example 1 diluted with water was prepared and then applied to the top and bottom caul plates by spraying at a rate of 2 g/sq. ft followed by baking. Eight 7/16" thick panels were hand formed and hot pressed on a 12" by 12" hot-press at 193° C. to a board density of 43 lb/ft$^2$. Each of the panels used decreasing application rates of the 10% solution of the XP1001J on the top and bottom caul plates beginning at 6 g/sq. ft with the last two panels being pressed with no additional application of the RA. As a control, four panels were prepared using a 10% solution of PRESS-GUARD™ (Guardian Chemicals Inc.). The results are shown in Table 2:

TABLE 2

Fiberboard Release Tests

| BOARD NO. | RELEASE AGENT | CONC. (%) | APPLI-CATION RATE (g/ft2) | RELEASE RATE TOP/ BOTTOM | COMMENTS |
|---|---|---|---|---|---|
| 1 | Pressguard | 10 | 5 | 5/5 | pre coated with 10% Pressguard at 2 g/ft2 and baked on the platen |
| 2 | Pressguard | 10 | 3 | 5/5 | |

TABLE 2-continued

Fiberboard Release Tests

| BOARD NO. | RELEASE AGENT | CONC. (%) | APPLI-CATION RATE (g/ft2) | RELEASE RATE TOP/ BOTTOM | COMMENTS |
|---|---|---|---|---|---|
| 3 | Pressguard | 10 | 2 | 5/5 | |
| 4 | Pressguard | 10 | 1 | 5/5 | |
| 5 | XP1001J | 10 | 6 | 5/5 | pre coated with 10% XP1001J at 2 g/ft2 and baked on the platen |
| 6 | XP1001J | 10 | 5 | 5/5 | |
| 7 | XP1001J | 10 | 4 | 5/5 | |
| 8 | XP1001J | 10 | 3 | 5/5 | |
| 9 | XP1001J | 10 | 2 | 5/5 | |
| 10 | XP1001J | 10 | 1 | 5/5 | |
| 11 | XP1001J | 10 | 0 | 5/4 | |
| 12 | XP1001J | 10 | 0 | 4/3 | sticking gradually increased |

Notes
Press temperature: 193 C.
Press time: 5 minutes
Resin: pMDI - Huntsman
Resin content: 5%
board dimension: 1 × 1'
board thickness: 7/16"
Oven dry fiber moisture content: 4-5%
release rate: 1 is the worst and 5 is the best The release agent performed extraordinarily well at a 10% concentration and at all spray rates without any difficult to separate the board from the caul plates and compared very well with the PRESSGUARD™. The long acting effect of the release agent was tested by pressing boards with no additional application of release agent and shows good release for the first board without release agent application after 6 boards with release agent application (Board 11), but gradually the release properties diminish with some sticking occurring for Board 12 (some difficulty to separate the caul plate and board).

The compositions of the present invention of a mixture of an alkali metal salt of a fatty acid and a alkali metal salt of a phosphate ester having an HLB number of 4 or less in a water based system with mixing produce a smooth, stable emulsion. The emulsified release agent composition displays no significant separation, even on dilution, and does not significantly foam when used in application processes which agitate the release agent during the application process, such as spinning disc spray or rotating roller systems. The compositions do not require the addition of separate de-foaming agents to achieve low-foaming properties, thus greatly reducing the cost and complexity of the manufacture of fiberboard and OSB using pMDI as adhesives, and yielding an improved product with excellent paintability.

The emulsified release agent of the present invention is simple to manufacture and has good stability and storage characteristics. In addition, the emulsified release agent provides effective release during production of wood products from wood fibers or chips, in conventional processes at conventional speeds using many popular release agent application systems including high agitation systems such as spinning disc spray or rotating roller systems, without causing excessive press buildup. Moreover, the lack of the need to add a de-foaming agent, particularly those which are silicone-based, yields finished boards with improved physical properties. Even at extreme pMDI concentrations of 10%, the emulsified release agent compositions of the present invention provide exceptional release characteristics with the finished board slipping easily off the plates with no sticking.

Although various preferred embodiments of the present invention have been described herein in detail, it will be appreciated by those of skill in the art that variations may be made thereto without departing from the spirit of the invention or the scope of the appended claims.

We claim:

1. An emulsified release agent composition for use with a pMDI adhesive comprising an emulsified mixture of:
(a) an alkali metal salt of a fatty acid having 8-18 carbon atoms, and
(b) an alkali metal salt of a phosphate ester having 6-22 carbon atoms and having an HLB number of 4 or less.

2. The emulsified release agent composition of claim 1 further comprising (c) an ethoxylated fatty alcohol having an alkyl chain length of 8-18 carbon atoms.

3. The emulsified release agent composition of claim 2 comprising:
(a) 1-20% by weight of an alkali metal salt of a fatty acid having 8-18 carbon atoms;
(b) 1-20% by weight of an alkali metal salt of a phosphate ester having 6-22 carbon atoms and having an HLB number of 4 or less;
(c) 1-10% by weight of an ethoxylated fatty alcohol having an alkyl chain length of 8-18 carbon atoms;
(d) 0.05-0.5% by weight of a preservative; and
(e) the balance by weight of deionized water.

4. The emulsified release agent composition of claim 3 comprising:
(a) 10-12% by weight of an alkali metal salt of a fatty acid having 8-10 carbon atoms;
(b) 10-12% by weight of an alkali metal salt of a phosphate ester having 8-12 carbon atoms and having an HLB number of 4 or less;
(c) 0-5% by weight of an ethoxylated fatty alcohol having an alkyl chain length of 8-18 carbon atoms;
(d) 0.2% by weight of a preservative; and
(d) 70.8-79.8% by weight deionized water.

5. The emulsified release agent composition of claim 4 wherein the alkali metal salt of the fatty acid and the phosphate ester having an HLB number of 4 or less are independently selected from a lithium, potassium or sodium salt.

6. The emulsified release agent composition of claim 4 wherein the alkali metal salt of the fatty acid and the phosphate ester having an HLB number of 4 or less are independently selected from a potassium or sodium salt.

7. The emulsified release agent composition of claim 4 wherein the alkali metal salt of the fatty acid and the phosphate ester having an HLB number of 4 or less are each a sodium salt.

8. The emulsified release agent composition of claim 4 comprising
(a) 10% by weight of a sodium salt of a tall oil fatty acid;
(b) 10% by weight of a sodium salt of a mixture of mono- and di-C8-10-alkyl ethers, phosphates having an HLB number of 4 or less;
(c) 0.2% by weight of 2-bromo-2-nitropropane-1,3-diol, 5-chloro-2-methyl-4-isothiazolin-3-one, 2-methyl-4-isothiazolin-3-one or 1,3-benzothiazol-2-ylsulfanylmethyl thiocyanate as a preservative; and
(d) 77.1% by weight deionized water.

9. The emulsified release agent composition of claim 3 wherein the alkali metal salt of the fatty acid and the phosphate ester having an HLB number of 4 or less are independently selected from a lithium, potassium or sodium salt.

10. The emulsified release agent composition of claim 3 wherein the alkali metal salt of the fatty acid and the phosphate ester having an HLB number of 4 or less are independently selected from a potassium or sodium salt.

11. The emulsified release agent composition of claim 3 wherein the alkali metal salt of the fatty acid and the phosphate ester having an HLB number of 4 or less are each a sodium salt.

12. The emulsified release agent composition of claim 1 wherein the alkali metal salt of the fatty acid and the phosphate ester having an HLB number of 4 or less are independently selected from a lithium, potassium or sodium salt.

13. The emulsified release agent composition of claim 1 wherein the alkali metal salt of the fatty acid and the phosphate ester having an HLB number of 4 or less are independently selected from a potassium or sodium salt.

14. The emulsified release agent composition of claim 1 wherein the alkali metal salt of the fatty acid and the phosphate ester having an HLB number of 4 or less are each a sodium salt.

15. A method for applying a emulsified release agent to a fiber mat or caul plate used in the manufacture of an oriented strand board, the method comprising providing a emulsified release agent comprising an emulsified mixture of (a) 1-20% by weight of an alkali metal salt of a fatty acid having 8-18 carbon atoms; (b) 1-20% by weight of an alkali metal salt of a phosphate ester having 6-22 carbon atoms and having an HLB number of 4 or less; (c) 0-10% by weight of an ethoxylated fatty alcohol having an alkyl chain length of 8-18 carbon atoms; (d) 0.05-0.5% by weight of a preservative; and (e) the balance by weight of deionized water, loading the emulsified release agent in a spinning disk spray system or a rotating roller application system and thereafter applying the emulsified release agent to the fiber mat or caul plate using said system.

16. The method of claim 15 wherein the emulsified release agent composition comprises:

(a) 10-12% by weight of an alkali metal salt of a fatty acid having 8-10 carbon atoms;

(b) 10-12% by weight of an alkali metal salt of a phosphate ester having 8-12 carbon atoms and having an HLB number of 4 or less;

(c) 0-5% by weight of an ethoxylated fatty alcohol having an alkyl chain length of 8-18 carbon atoms;

(d) 0.2% by weight of a preservative; and (d) 70.8-79.8% by weight deionized water.

17. The method of claim 15 wherein the alkali metal salt of the fatty acid and the phosphate ester having an HLB number of 4 or less are independently selected from a potassium or sodium salt.

18. The method of claim 15 wherein the alkali metal salt of the fatty acid and the phosphate ester having an HLB number of 4 or less are each a sodium salt.

* * * * *